US005310519A

United States Patent [19]

Blaimschein

[11] Patent Number: 5,310,519

[45] Date of Patent: May 10, 1994

[54] PROCESS OF MANUFACTURING AS SINTERED MEMBER HAVING AT LEAST ONE MOLYBDENUM-CONTAINING WEAR-RESISTING LAYER

[75] Inventor: Franz Blaimschein, Sattledt, Austria

[73] Assignee: Miba Sintermetall Aktiengesellschaft, Laakirchen, Austria

[21] Appl. No.: 902,577

[22] Filed: Jun. 22, 1992

[30] Foreign Application Priority Data

Jul. 2, 1991 [AT] Austria ..... 1314/91

[51] Int. Cl.[5] ..... B22F 3/00

[52] U.S. Cl. ..... 419/47

[58] Field of Search ..... 419/47

[56] References Cited

U.S. PATENT DOCUMENTS 4,678,633 7/1987 Osaki et al. ..... 419/47 X 5,069,867 12/1991 Zengin ..... 419/47 X

FOREIGN PATENT DOCUMENTS 2822902 11/1979 Fed. Rep. of Germany .

*Primary Examiner*—Peter A. Nelson

*Attorney, Agent, or Firm*—Collard & Roe

[57] ABSTRACT

To make a sintered member having a molybdenum-containing wear-resisting layer it is known to compact a low-alloy iron powder for forming the body of said member and a non-alloyed iron-base metal powder, which contains molybdenum and is intended to form the wear-resisting layer, so as to form a shaped member, which is subsequently sintered. In order to reduce the manufacturing costs, it is proposed that in such process the metal powder for forming the wear-resisting layer contains a low-alloy iron powder and 10 to 30% by weight molybdenum and contains a total of 1.5 to 3.0% by weight carbon and phosphorus, carbon and phosphorus are optionally contained as alloying constituents in the iron powder of said metal powder in a total amount of 0.3 to 0.7% by weight, and the shaped member consisting of the body and the wear-resisting layer is subjected to liquid-phase sintering at temperatures from 1070° to 1130° C.

3 Claims, No Drawings

PROCESS OF MANUFACTURING AS SINTERED MEMBER HAVING AT LEAST ONE MOLYBDENUM-CONTAINING WEAR-RESISTING LAYER

BACKGROUND OF THE INVENTION

1. Field of the Invention

This invention relates to a process of manufacturing a sintered body having at least one molybdenum-containing wear-resisting layer, wherein a low-alloy iron powder, which is intended to form the body of the member, and an iron-base metal powder, which contains non-alloyed molybdenum and is intended to form said wear-resisting layer are compacted to form a shaped member, which is subsequently sintered.

2. Description of the Prior Art

To provide valve tappets which can take up high loads for use in internal combustion engines, it is known (from German Patent Specification 2 822 902) to provide the valve tappet with a war-resisting sintered layer, which has a high molybdenum content of 20 to 35% by weight. That wear-resisting layer is formed in that a metal powder is compacted in a common mold together with the low-alloy iron powder used to form the body of the valve tappet. That metal powder consists of a carbon-free mixture of non-alloyed iron and non-alloyed molybdenum so that the valve tappet can be sintered at high sintering temperatures up to 1350° C. by dry-phase sintering at a high sintering rate.

To increase the wear resistance the wear-resisting sintered layer is subsequently carburized so that mixed carbides are formed. Molybdenum is an excellent carbide-forming constituent and affords the additional advantage that the resulting layer has only a low tendency to corrode the material of the cam in contact with said layer. But said good material properties can be achieved only by an expensive manufacture because the sintering temperature must be relatively high and a carburizing is subsequently required.

SUMMARY OF THE INVENTION

It is an object of the invention so to improve the process of the kind described first hereinbefore that a sintered member, particularly for actuating a valve of an internal combustion engine, can be provided at low cost with a wear-resisting layer which has a high load-carrying capacity.

That object is accomplished in accordance with the invention in that the metal powder for forming the wear-resisting layer contains a low-alloy iron powder and 10 to 30% by weight molybdenum and contains a total of 1.5 to 3.0% by weight carbon and phosphorus, carbon and phosphorus are optionally contained as alloying constituents in the iron powder of said metal powder in a total amount f 0.3 to 0.7% by weight, and the shaped member consisting of the body and the wear-resisting layer is subject to liquid-phase sintering at temperatures from 1070° to 1130° C.

Because the metal powder used to form the wear-resisting layer has a relatively high carbon content, the sintering process results in the formation of a large number of mixed carbides, which are uniformly distributed throughout the wear-resisting layer during the liquid-phase sintering. As a result, wear-resisting layers can be formed which have a larger thickness and a more uniform wear resistance throughout their thickness than in case of a formation of carbides by a subsequent carburizing. In conjunction with the carbon content the phosphorus content permits the liquid-phase sintering to be performed at a distinctly lower temperature so that the sintering can be performed at relatively low cost and the dimensional stability is improved. In spite of the use of carbon and of the sintering with a pronounced liquid phase, there is only a limited tendency to form austenite so that a sufficiently high fatigue strength is achieved.

A wear-resisting layer having particularly good material properties will be obtained with a molybdenum content of 15 to 25% by weight. The provision of such a molybdenum content will ensure a carbide content which is sufficient for a satisfactory wear resistance whereas a higher wear of the members which are to cooperate with the sintered member need not be feared. In that case the metal powder used to form the wear-resisting layer will preferably have a carbon content between 1.8 and 2.8% by weight.

EXAMPLE

To make a drag lever for a valve-actuating mechanism of an internal combustion engine the body of the lever was made from a commercially available, diffusion-alloyed sinterable powder, which contained 5% by weight nickel, 2% by weight copper, 1% by weight molybdenum, and 0.5% by weight carbon, balance iron and incidental impurities. The metal powder for making the wear-resisting layer for cooperating with a cam of a camshaft contained in addition to a major amount of non-alloyed iron powder about 25% by weight molybdenum, 0.5% by weight of phosphorus as ferrophosphorus and 2.4% by weight carbon as natural graphite. The iron powder had a maximum particle size below 75 micrometers and a major part of it had an average particle size below 10 micrometers. The molybdenum powder had an average particle size of 8 micrometers and a maximum particle size of 35 micrometers. The natural graphite powder had a particle size below 5 micrometers and the ferrophosphorus powder had a particle size below 12 micrometers. Said mixed powders for making the wear-resisting layer were compacted to form a compact which had a density of 6.2 g/cm$^3$ and which was subsequently compacted together with the sinterable powder for making the body in a common mold for making a drag lever, which was subsequently presintered at a temperature of 800° C. in a nitrogen-hydrogen atmosphere. The presintered drag lever was subsequently calibrated and was then subjected to liquid-phase sintering in a belt conveyor furnace at a sintering temperature between 1080° and 1120° C. for 60 minutes. After the drag lever had cooled down the wear-resisting layer was found to have a measured hardness of 600 VHN, which by an additional hardening treatment was increased to 950 VHN 10.

It will be understood that the invention is not restricted to the embodiment shown by way of example. For instance, liquid-phase sintering might be performed in a vacuum furnace at the same sintering temperatures. Besides, presintering will not be required if the compacted workpiece has such a high green strength that it can be handled in process. Calibrating will mainly be desirable if the body is required to have a particularly high dimensional stability and strength. Besides, the powder for the body need not initially be compacted in a common mold with the wear-resisting layer although such initial compacting in a common mold will afford advantages.

I claim:

1. A process of manufacturing a sintered member comprising a body and a wear-resistant layer, which comprises the steps of forming said body of a low-alloy iron powder, forming said wear-resistant layer of an iron powder containing 10% to 30%, by weight, of non-alloyed molybdenum, 1.5% to 3%, by weight, of carbon and 0.3% to 0.6%, by weight, of phosphorus, compacting the body-forming and layer-forming powders to form a shaped member, and subjecting the shaped member to liquid-phase sintering at a temperature of 1070° C. to 1130° C.

2. The manufacturing process of claim 1, wherein the iron powder forming the wear-resistant layer contains 15% to 25%, by weight, of the non-alloyed molybdenum.

3. The manufacturing process of claim 2, wherein the iron powder forming the wear-resistant layer contains 1.8% to 2.8%, by weight, carbon.

* * * * *